US005226614A

United States Patent [19]

Carlson

[11] Patent Number: 5,226,614

[45] Date of Patent: Jul. 13, 1993

[54] INFRARED TRACKER FOR A PORTABLE MISSILE LAUNCHER

[75] Inventor: James J. Carlson, Woodland Hills, Calif.

[73] Assignee: Hughes Aircraft Company, Los Angeles, Calif.

[21] Appl. No.: 855,974

[22] Filed: Mar. 23, 1992

[51] Int. Cl.[5] ..... F41G 7/00

[52] U.S. Cl. ..... 244/3.11; 244/3.13

[58] Field of Search ..... 244/3.11, 3.13

[56] References Cited

U.S. PATENT DOCUMENTS 4,202,515 5/1980 Maxwell, Jr. ..... 244/3.11
4,397,429 8/1983 Fouilloy ..... 244/3.11
4,407,464 10/1983 Linick ..... 244/3.13
4,967,979 11/1990 Balstad ..... 244/3.11
5,082,201 1/1992 Le Bars et al. ..... 244/3.16

*Primary Examiner*—J. Woodrow Eldred
*Attorney, Agent, or Firm*—C. D. Brown; R. M. Heald; W. K. Denson-Low

[57] ABSTRACT

A portable missile launcher (12) has all of the infrared tracker (20) mounted to the same housing (48). The infrared missile beacon image beam (26) is intercepted by a rotating prism (28) which directs a portion of the beam to a narrow field detector (32) and reflects a further portion from a coating (30) onto a wide field detector (34). The detectors (32,34) provide yaw and pitch signals (40,42) which are compared with on-course information producing error signals communicated to the missile for course correction, if needed.

9 Claims, 2 Drawing Sheets

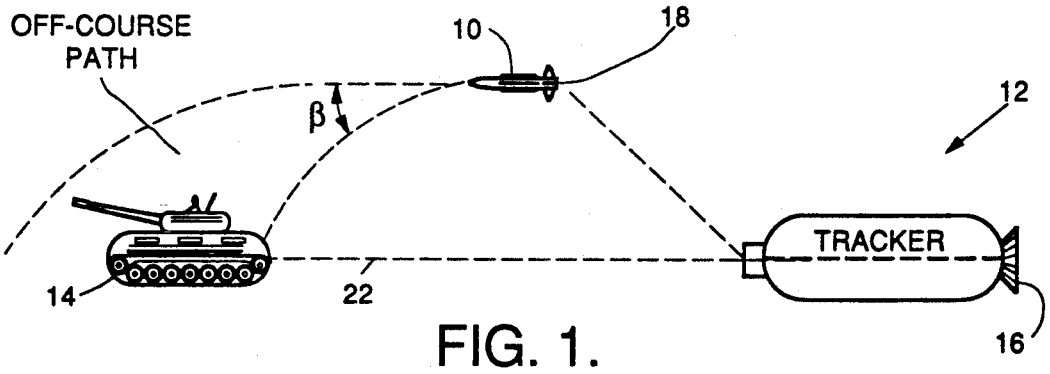
FIG. 1.
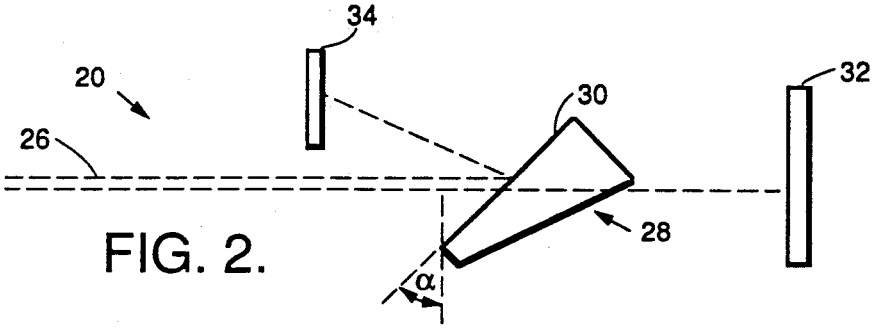
FIG. 2.
FIG. 3a.
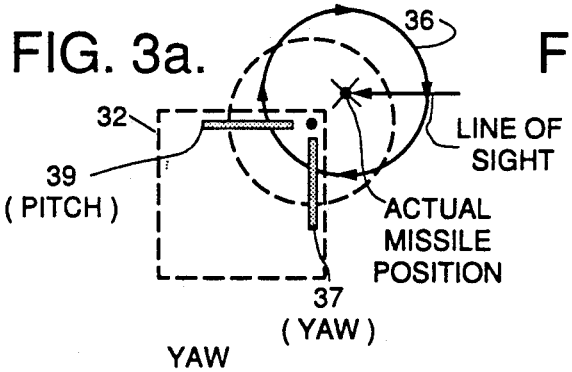
FIG. 3b.
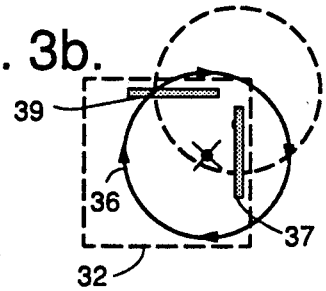
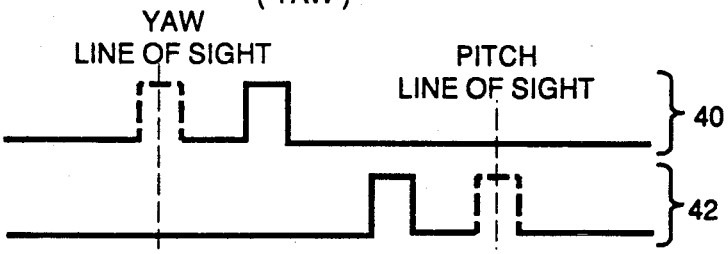
FIG. 4a.
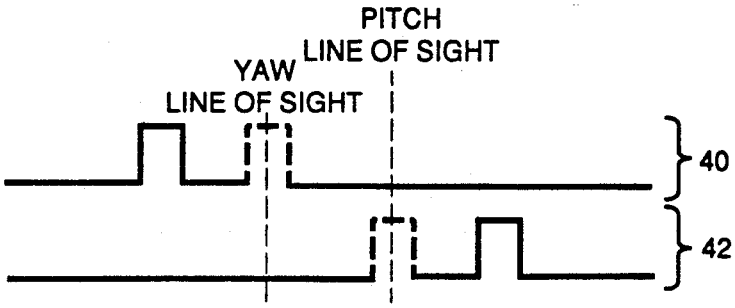
FIG. 4b.

INFRARED TRACKER FOR A PORTABLE MISSILE LAUNCHER

BACKGROUND

1. Field of the Invention

The present invention relates generally to a missile tracker, and, more particularly, to such a tracker which forms a part of the optical target monitoring apparatus and infrared missile tracking system for a portable missile launcher.

2. Description of Related Art

In one form of missile with which the present invention is especially advantageous, the missile being deployed toward a particular target includes an infrared beacon which is separately monitored by launch site equipment in order to determine the course of the missile and to make mid-course corrections, where necessary, to insure target engagement. Accordingly, such present day missile launch control systems have two major parts, namely, a visual monitoring system and an infrared beacon sensing and tracking equipment. The infrared tracker produces a guidance error signal and comparison of the optical with the IR tracking of the beacon is assisted by electronic guidance control apparatus which calculates and provides signals to the missile for use in producing midcourse corrections, if found necessary.

In portable missile launchers it is a primary aim to unitize construction and simplify operation as much as possible while at the same time keeping overall weight to a reasonable minimum. All known portable missile launchers have been found subject to optical boresight shifts due to thermal gradients and production of angular noise resulting from mechanical gear drive operation linking a motor resolver and spin prism, for example, producing diminished operational efficiency. The referenced gear source noise problem has also been found to worsen as a tracking system ages, and it is, therefore, a desideratum to entirely eliminate this deficiency from portable missile launchers.

SUMMARY OF THE INVENTION

In the tracker system of the present invention, the image of the missile beacon is received initially by a rotating beam splitter prism which nutates the image and directs a greater amount of the image light energy onto a narrow field detector and the remaining smaller portion of the energy onto a wide field detector. Yaw detectors are vertically arranged elements of each detector and pitch detectors are horizontally arranged elements.

When the missile is on target, (i.e., error angle is zero) all of the detector elements lie on orthogonal radii of the nutation circle. When the missile is off target (i.e., an error angle of $\beta$ exists) the nutation circles are displaced from their zero error angle by the angle $\beta$. This error angle results in the phase of the detector signal shifting its phase a corresponding amount. Since there are two orthogonally related sets of detectors, the relationship applies independently to both pitch and yaw. Electronics is also provided for forming correction signals to be sent to the missile to zero out the error signal and return the missile to the proper course.

In a preferred embodiment, preamplifiers for the missile tracker rely upon surface-mounted parts eliminating previously used relatively long interconnection leads, the net result of which is a more rigid mounting and elimination of much of the noise and microphonics found in prior discrete components with relatively long lead circuits. A brushless pulse powered D.C. motor provides a highly accurate drive for the prism as well as for a shaft encoder, the latter, in structure, including a glass ring bonded to the outside of the spinning prism housing.

BRIEF DESCRIPTION OF THE DRAWING

FIG. 1 is a schematic view of a portable launcher shown in use controlling flight of a missile;

FIG. 2 is a partially schematic representation of the near infrared tracker of this invention;

FIGS. 3A and 3B depict relative light beam traces for two off-course tracking conditions;

FIGS. 4A and 4B show electric signal pulses generated for the off-course conditions of FIGS. 3A and 3B, respectively.

DESCRIPTION OF A PREFERRED EMBODIMENT

Figure 5:
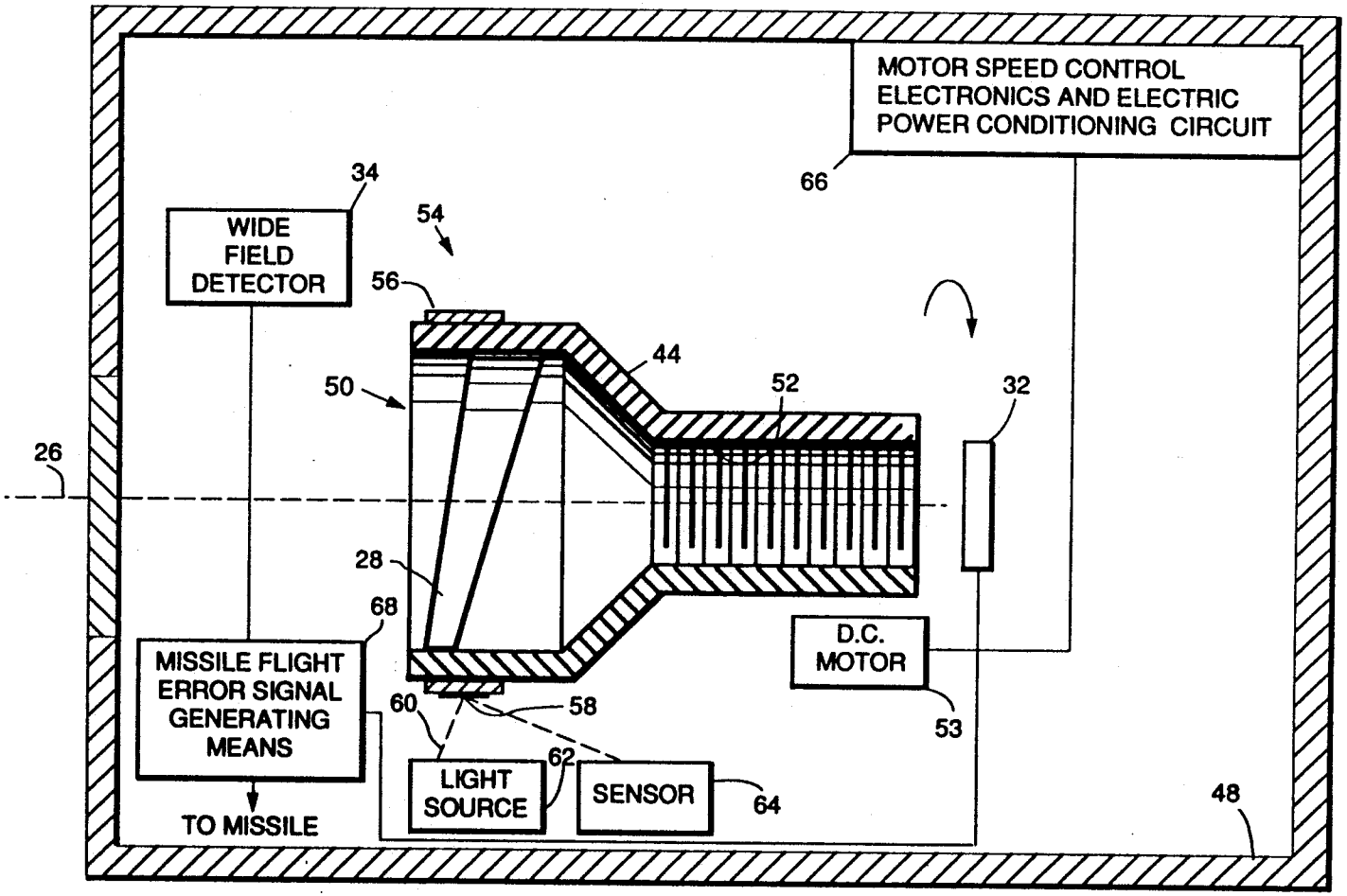
FIG. 5 is an elevational partially sectional view of the infrared tracker prism drive and synchronization means.

With reference now to the drawing and particularly to FIG. 1, there is shown a missile 10 which has been launched by a portable launcher 12 toward a target 14. During flight, the target is monitored visually by use of telescopic apparatus in the launcher via an eyepiece 16 and the missile is tracked by monitoring a near infrared light producing xenon beacon 18 on the missile with tracker apparatus 20. As will be more particularly described, the tracker apparatus develops an error signal on detecting that the missile 10 has deviated from the desired course 22 and then provides course correcting signals to the missile.

Turning now essentially to FIG. 2, the tracker apparatus 20 of this invention receives near infrared light energy from the missile 10 along boresight 26 and focuses it onto a rotating beamsplitter prism 28. More particularly, the prism when seen from the side as in FIG. 2 is wedge-shaped with the surface facing toward the missile being maintained slightly tilted with respect to a vertical line to the boresight 26. A thin film 30 on the prism front surface acts as a beamsplitter for the incoming light energy allowing the major part of the light energy (e.g., 90%) to pass through the prism and impinge upon near infrared sensors 32 for providing a narrow field of view. The remaining incoming light energy (e.g., 10%) is reflected from the beamsplitter film 30 onto a near infrared sensor 34 referred to here as providing a wide field of view.

Since, as already noted, the prism surface carrying the film 30 is canted (angle $\alpha$) with respect to the vertical, the light energy impinging upon the sensors 32 and the light energy reflected onto sensors 34 forms a nutating image as the prism rotates about the boresight 26 as an axis. FIGS. 3A and 3B show a large circle 36 which defines the path traced by the image on sensors 32 as a result of two different off-course conditions, namely, yaw left and pitch down (FIG. 3A) and yaw right and pitch up (FIG. 3B). The yaw detector 37 extends vertically, while the horizontally arranged sensors 39 measures pitch.

When the missile is on course, there is a zero error angle and all of the sensor elements lie on orthogonal radii of the nutation circle. On the other hand, when the missile is off course (e.g., error angle of $\beta$ exists), the nutation circles are displaced from the on-course condition by the amount indicated by the angle $\beta$. When such an error signal exists, this produces a shift in the signal phase from the on-course phase by an amount equal to arcsin($\beta$/radius of nutation circle). Since the detector arrays have their sensors arranged in two orthogonal patterns, for yaw and pitch respectively, there are two separate error signals formed.

The sensor 34, as already noted provides a relatively wide field of view. A similarly set of pulses is obtained for a narrow field of view which occurs on sensor 32 responding to a circle traced by the infrared beam reflecting from the prism onto the sensor.

FIG. 4 shows in graphical form the electrical pulses provided by the system for both yaw and pitch. FIG. 4A shows a pair of pulses 40 from the yaw detector and a further pair of pulses 42 from the pitch array corresponding to the tracking situation of FIG. 3A, namely, pitch downward and yaw to the left. Similarly, pulses 40 and 42 in FIG. 4B show the relative pulse positions have shifted for the tracking situation of FIG. 3B, namely, pitch is up and yaw is to the right. The system then generates corrective signals which are transmitted to the missile for bringing it on course.

For the ensuing description of the constructional arrangement of the various elements of the invention, reference is made especially to FIG. 5. As shown, the beamsplitter prism 28 is directly affixed to the outer end of a hollow rotative power driveshaft 44 mounted within a portable launcher housing 48. The driveshaft has an axial passage 50 to allow the incident radiation from the missile beacon 18 to be directed unimpeded onto the front surface of the prism and pass through the prism. To minimize reflection of incoming radiation off the internal walls 52 of the passage 50 and avoid errors from that source, these walls are threaded and painted black. In a practical construction of the invention, the brushless motor 53 is D.C. pulse driven at 20 Hertz.

Synchronization in systems having rotating parts was achieved in the past through the use of a resolver which is a mechanical electromagnetic device that can provide accurate angular disposition of a rotatable shaft, for example. Resolvers are undesirably subjected to "jitter" because the slope of the output waveform is relatively gradual and detection of a zero crossing may vary. Instead of a resolver, the present invention uses a shaft encoder 54 which, essentially, consists of a glass ring 56 bonded to an outer surface of the prism drive shaft. A timing mark 58 on the glass ring causes reflection of a beam 60 from light source 62 which generates a timing pulse in sensor 64 for synchronization use in control 66. An encoder of this kind can produce a very precise pulse not subject to the jittering difficulty associated with resolvers.

It is a further and advantageous aspect of the invention that all of the infrared light energy tracker parts discussed in the immediately preceding paragraphs are integrally secured to the housing 48 making the invention especially well adapted for use with a portable missile tracker. For example, the motor speed control electronics and electric power conditioning circuits are integrally packaged in the unit and enumerated as 66 mounted within housing 48. Means 68 responsive to the wide and narrow field of view detectors are also provided for generating course error signals and transmitting them to the missile for effecting course connection, if necessary. Details of electronics, motor control and the like are not deemed pertinent to understanding of the present invention, and, therefore, are not shown in the drawing or described.

Although the invention has been described in connection with a preferred embodiment, it is understood that one skilled in the appertaining arts may suggest modifications that come within the spirit of the invention as described and within the ambit of the appended claims.

What is claimed is:

1. An infrared beam tracker for arrangement to a housing that is unitary with a portable missile launcher, comprising:

a rotating beamsplitter positioned to intercept the infrared beam passing a first portion of the beam through the beamsplitter along a first direction and reflecting the remaining portion along a different direction;

a first infrared detector for receiving the beam reflected portion from the beamsplitter and produce electric signals responsive thereto;

a second infrared detector for receiving the beam portion that passes through the beamsplitter and providing electric signals responsive thereto; and means interconnected to the first and second infrared detectors and responsive to the electric signals generated by said detectors for determining errors in missile flight direction and communicating course correction information to the missile.

2. An infrared beam tracker as in claim 1, in which the first infrared detector is responsive to infrared radiation received over a relatively wide field of view and the second detector is responsive to radiation received over a relatively narrow field of view.

3. An infrared beam tracker as in claim 1, in which each detector includes infrared sensors arranged to extend in two mutually orthogonal directions, one for measuring missile yaw and one for measuring missile pitch.

4. An infrared beam tracker as in claim 1, in which the beamsplitter includes a wedge shaped prism having a beamsplitting coating on a surface disposed to face incoming infrared radiation.

5. An infrared beam tracker as in claim 4, in which the surface on which the coating is deposited is flat and arranged at an angle other than 90 degrees to the direction of the incoming infrared beam.

6. An infrared beam tracker as in claim 1, in which the beamsplitter is mounted onto a hollow shaft the axis of which is directed toward the source of infrared radiation, the second detector being located to receive infrared radiation that has passed through the beamsplitter and then through the hollow shaft.

7. An infrared beam tracker as in claim 6, in which the walls defining the hollow shaft bore are provided with threads and coated with a relatively poor reflector material.

8. An infrared beam tracker as in claim 1, in which the beamsplitter is rotated by a brushless D.C. pulsed electric motor.

9. Apparatus integral with a portable missile launcher for tracking a near infrared beam emitted by a beacon carried by the missile, comprising:

a rotatably mounted prism having a surface eccentrically arranged with respect to its axis of rotation;

a beamsplitting coating on the prism surface for receiving the beam from the beacon;

a D.C. pulsed electric motor for providing rotative power to the prism; and first and second infrared detectors for receiving reflected and pass-through portions of the beam, respectively, and producing electric signals responsive thereto.

* * * * *